US008881927B2

(12) United States Patent
West et al.

(10) Patent No.: US 8,881,927 B2
(45) Date of Patent: Nov. 11, 2014

(54) PINCH TOP CLOSURE SYSTEM

(76) Inventors: Ellery West, Crescent City, CA (US); Gail West, Crescent City, CA (US)

( * ) Notice: Subject to any disclaimer, the term of this patent is extended or adjusted under 35 U.S.C. 154(b) by 0 days.

(21) Appl. No.: 13/320,594

(22) PCT Filed: May 13, 2010

(86) PCT No.: PCT/US2010/034648

§ 371 (c)(1),
(2), (4) Date: Dec. 28, 2011

(87) PCT Pub. No.: WO2010/132632

PCT Pub. Date: Nov. 18, 2010

(65) Prior Publication Data

US 2012/0138613 A1 Jun. 7, 2012

Related U.S. Application Data

(60) Provisional application No. 61/178,855, filed on May 15, 2009.

(51) Int. Cl.

| | |
|---|---|
| ***B65D 53/00*** | (2006.01) |
| ***B65D 39/02*** | (2006.01) |
| ***B65D 39/12*** | (2006.01) |
| ***B65D 65/46*** | (2006.01) |

(52) U.S. Cl.

CPC ..... *B65D 39/025* (2013.01); *B65D 39/12* (2013.01); *B65D 65/466* (2013.01)

USPC ..... 220/233

(58) Field of Classification Search

CPC ..... B65D 45/00; B65D 55/10; B65D 55/02

USPC ..... 220/233, 238, 260, 281, 320, 323, 787, 220/789, 791, 801; 215/295, 296, 297, 305, 215/363; 229/93

See application file for complete search history.

(56) References Cited

U.S. PATENT DOCUMENTS

| | | | | | |
|---|---|---|---|---|---|
| 581,157 | A | * | 4/1897 | Hannaford | 215/52 |
| 2,866,574 | A | * | 12/1958 | Roumeliotis | 220/326 |
| 3,658,096 | A | * | 4/1972 | Higuera | 138/90 |
| 3,827,462 | A | * | 8/1974 | Celesta | 138/90 |
| 4,271,973 | A | * | 6/1981 | Quagliaro et al. | 215/308 |
| 4,413,748 | A | * | 11/1983 | Kessler et al. | 220/281 |
| 4,942,970 | A | * | 7/1990 | Jay | 215/358 |

(Continued)

FOREIGN PATENT DOCUMENTS

| | | | |
|---|---|---|---|
| DE | 196141 | | 1/1907 |
| DE | 196141 | C * | 1/1907 |

(Continued)

*Primary Examiner* — Anthony Stashick
*Assistant Examiner* — Jennifer N Zettl
(74) *Attorney, Agent, or Firm* — Fish & Tsang LLP

(57) ABSTRACT

A closure system (100) includes a container (110) having a ridge (130), a land (140), and a groove (150) disposed between the ridge and the land. A plug (120) can be inserted into the container to create a seal between the land and the plug. The plug can have a first member (160) sized and dimensioned to rest upon the land, and a second member (170) having a catch (180) that is extendable into, and retractable from, the groove. One or more rubber layers (344, 444) can be disposed between the land and the first member to improve the seal between the first member and the land.

16 Claims, 2 Drawing Sheets

(56) References Cited

U.S. PATENT DOCUMENTS

| | | | | |
|---|---|---|---|---|
| 5,129,544 | A * | 7/1992 | Jacobson et al. | 220/562 |
| 5,168,995 | A | 12/1992 | German | |
| 5,249,549 | A * | 10/1993 | Rockaitis, III | 119/165 |
| 5,845,800 | A * | 12/1998 | Shaw et al. | 220/210 |
| 5,927,340 | A * | 7/1999 | Barton | 138/92 |
| 6,193,093 | B1 * | 2/2001 | Brunner | 220/234 |
| 6,439,409 | B1 * | 8/2002 | Dressel et al. | 215/228 |
| 7,591,394 | B1 * | 9/2009 | Shingle | 220/789 |
| 2005/0161463 | A1 * | 7/2005 | Litchman | 220/787 |
| 2008/0067141 | A1 | 3/2008 | Murakami et al. | |
| 2008/0302808 | A1 | 12/2008 | Maxwell | |
| 2009/0086101 | A1 | 4/2009 | Lee | |
| 2012/0055926 | A1 * | 3/2012 | Turvey et al. | 220/315 |
| 2012/0193371 | A1 * | 8/2012 | Lai | 220/801 |

FOREIGN PATENT DOCUMENTS

| | | | |
|---|---|---|---|
| DE | 251283 | | 11/1911 |
| DE | 251283 | C * | 11/1911 |
| FR | 2788498 | | 1/1999 |
| GB | 2238270 | | 5/1991 |
| JP | 2001088853 | | 4/2001 |
| WO | WO2007140538 | A1 * | 12/2007 |
| WO | 2010/022267 | | 2/2010 |

* cited by examiner

PINCH TOP CLOSURE SYSTEM

This application claims priority to U.S. provisional application with Ser. No. 61/178,855 filed on May 15, 2009. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is closure systems.

BACKGROUND

Plastic container systems with caps, lids, and corks, are widely known in consumer goods and products. Unfortunately, because plastics typically have an extremely slow rate of decomposition, such plastics must be either recycled through costly industrial processes, or otherwise tossed into landfills where they will remain for centuries.

In an attempt to provide a more degradable closure system, the use of plastics such as polylactic acid polymers (PLA) have become more commonplace. However, such plastics still require specialized processes and facilities for degradation, which requires significant costs for its decomposition. In addition, PLA and similar plastics are visibly indistinguishable from normal plastics. This can be problematic because if the PLA is inadvertently placed within a group of traditional plastics to be recycled, the PLA can interfere with the normal recycling process.

Existing biodegradable closure systems are very limited; currently only non-threaded over-caps, pressure fitted discs and corks are used on consumer products. For example, WIPO Publication No. 2007/140538 to Henderson, et al. (publ. December 2007) discusses a biodegradable container and a biodegradable closure that can take the form of a plug, a membrane, or a seal. However, the Henderson closure typically cannot reseal the container once removed.

Such existing biodegradable closures have substantial shortcomings in providing a secure reusable closure that does not unduly stress a fiber-based container. For example, non-threaded over-caps and pressure fitted discs do not provide a secure positive closure. Furthermore, even though corks provide positive closure, when pressed into an opening they exert large outward forces on the opening and can weaken or crack the mouth of a fiber-based container. An alternative closure could be a threaded molded fibrous cap or lid that mates with threads on a container. Unfortunately, the threads on the closure and container would be relatively soft and likely to shear off when closed with the amount of force used by an average person. If a stiffening agent is infused in the fibrous pulp in order to strengthen the threads, the biodegradable qualities of the material are diminished.

UK Patent No. 2238270 to Hwang teaches a biodegradable lid for a beverage cup that is made of natural rubber latex. While the lid provides an effective reusable seal, various drawbacks remain. Specifically, the seal is achieved by stretching the lid over a container opening. This can put a significant amount of compressive force on the container. When the container is made of a biodegradable fibrous material, these compressive forces can easily distort or bend the container's body. On the other hand, if the lid is configured to not substantially apply a compressive force to the container, the seal is compromised and the lid may slip off U.S. Pat. No. 5,249,549 to Rockaitis discusses a disposable pet litter container having a lid that can be removed from and reinserted into a groove in the container to thereby seal the container. Although the lid and container can be composed of biodegradable materials, the lid is configured to be removed and reinserted into the container once. Repeated removal and reinsertion of the lid into the container would likely cause the lid to be deformed.

Thus, there is still a need for a reusable biodegradable closure system with an effective seal.

SUMMARY OF THE INVENTION

The inventive subject matter provides apparatus, systems and methods in which a closure system includes a container includes at least one opening and can have a ridge, a land, and a groove disposed between the ridge and the land. A plug can be inserted within the container's opening to thereby seal the container. The plug can have a first member sized and dimensioned to rest upon the land, and a second member having a catch that is extendable into, and retractable from, the groove.

As used herein, the term "plug" means a closure that does not cover the edges of a container. Plug does not include a "cap", which covers the edges of a container and extends along an outer surface of a container. Thus, a "plug" does not include caps for Thermos™ type bottles or other bottles where threads are an outside of the container.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
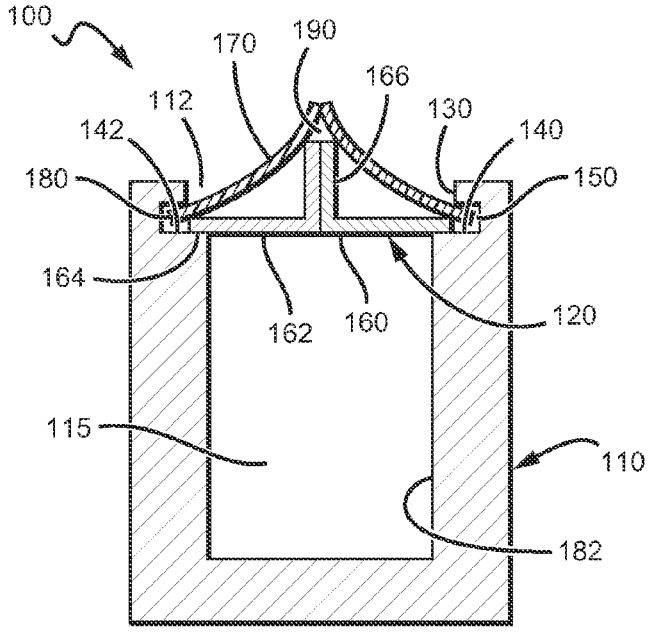
FIGS. 1A and 1B are cross-sectional views of an embodiment of a closure system.
Figure 1B:
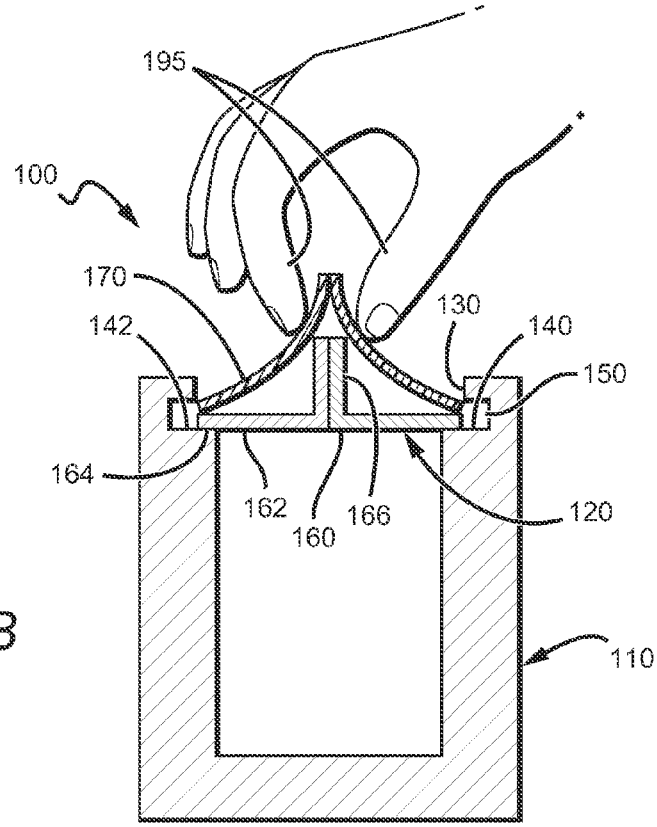

In FIGS. 1A-1B, a closure system 100 is shown having a container 110 and a plug 120. Preferably, the container 110 defines a lumen 115 and is composed of fibrous materials that have been molded, or paper that has been formed into a tubular or other commercially suitable shape. Plug 120 is configured to effectively seal container 110 and thereby seal the lumen 115. Both the container 110 and plug 120 are preferably impervious to liquid and may have a coating 182. Additionally, it is contemplated that closure system 100 and its components can be made of other biodegradable materials including, for example, potato starch, potato flour, corn starch, cereal flour, soybean oil, cellulose, polylactic acid polymers (PLA), polyalkanoate acid (PHA), or petrochemical derivatives. The plug 120 advantageously allows the closure system 100 to be repeatedly reused without deformation of the container 110 or plug 120.

As used herein the term "fibrous material" means a plurality of discrete fibers. The filaments can be plant or animal derived, synthetic, or some combination of these. In "plant-derived fibrous materials" the filaments are at least predominantly of plant origin, examples of which include wood, papyrus, rice, ficus, mulberry, fibers, cotton, yucca, sisal, bowstring hemp and New Zealand flax. Further, as used herein the term "fibrous wall" means a wall comprising a fibrous material as a significant structural constituent. The fibrous walls contemplated herein preferably have at least 2, 5, 10, 20 or even 30 dry weight percent of fibers. Preferably, the fibrous walls have at least 80 or 90 dry weight percent of fibers. Paper is generally a fibrous material that is usually made by pressing and de-watering moist fibers, typically cellulose pulp derived from wood, rags, or grasses. Preferably, if the container 110 is composed of one or more paper materials, then at least a portion of the plug 120 is composed of substantially the same chemical composition.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used herein, the term "liquid" means any semi-solid or other compound having a viscosity of at least 50 to 200,000,000 Centipoise. Preferred semi-solid compositions are medium viscosity compositions having a viscosity of 2,000 to 2,000,000 Centipoise, but low viscosity compositions in the range of at least 50 to less than 2000 Centipoise, as well as high viscosity compositions in the range of more than 2,000,000, up to 100,000,000 Centipoise are contemplated. Contemplated semi-solid compositions include lip balm, lip stick, skin cream, shampoo, deodorant, liquid soap, toothpaste, shoe polish, stain stick remover, and grease. Frozen goods such as ice cream are also contemplated.

As used herein the term "coating" means a permeation barrier that has a transfer rate of less than or equal to 50 μl of water and/or sunflower oil per $cm^2$ per six month period of time at room temperature and normal atmospheric pressure (STP). It is contemplated that the coating could be applied to parts of the container prior to assembly, or even after assembly. In some contemplated embodiments, the walls of the container can comprise a rolled paper material upon which the coating has been coated on the interior and exterior surfaces of the walls. Alternatively or additionally, the coating can be: (1) on an exterior surface or interior surface of the container; (2) impregnated within the material forming the walls of the container; or (3) disposed between the layers of walls of the container. A permeation barrier exists for "substantially all regions of the lumen" means a permeation barrier exists somewhere on the inner surfaces of the container, between the inner and outer surfaces of the container, or on the outer surfaces of the container for at least 95% of the surfaces defining the lumen. Thus, even if a non-barrier layer is buttressed by a barrier layer, this is still "substantially all regions of the lumen." As used herein, "lumen" means the inner space defined by the walls of the container.

In a preferred embodiment, the coating comprises an adhesive, which can be any compound in a liquid or semi-liquid state used to adhere or bond items together, and which is formed from a biodegradable material. Prior to use, adhesives can be pastes (very thick) or glues (relatively fluid). All suitable adhesives are contemplated, including for example Elmer's™ Glue (polyvinyl acetate), or simply a glue made from water, milk powder, vinegar and baking soda (e.g. a biodegradable adhesive). It is also contemplated that the coating can comprise a sugar cane protein. Other suitable coating materials include those disclosed in U.S. Pat. No. 7,344,784 to Hodson or US20050130261 to Wils.

Container 110 can be of any commercially suitable size and dimension. The opening 112 of the container 110 preferably has a maximum width or diameter of between 5 mm and 80 mm, although it is contemplated that the maximum width or diameter could be much larger depending upon the application. In preferred embodiments, container 110 has a ridge 130, a land 140, and a groove 150 between the ridge 130 and land 140. The ridge 130 is preferably disposed within 1 cm of an opening 112 of the container 110, although it is contemplated that the ridge 130 could be placed within 10 cm or more of the container opening 112, depending on the specific container and its use. Plug 120 can have a first member 160 that rests on an upper surface 142 of land 140. Plug 120 also can have a second member 170 with a catch 180.

First member 160 preferably is composed of fibrous materials, such as chipboard, and provides rigidity to plug 120. Second member 170 is preferably made of a latex, which has been vulcanized so that it provides a suitable elasticity. However, epoxidized soybean oil or other commercially suitable material(s) could be used such that the second member 170 has sufficient flexibility to be repeatedly removed from and inserted into groove 150. First member 160 provides rigidity under the normal amount of force that consumers use when handling containers. First member 160 can have a disk portion 162 with bottom surface 164, and a protrusion portion 166. The disk portion 162 is preferably substantially planar, but alternatively can have an inclined or declined portion. The protrusion portion 166 preferably extends perpendicular from the disk portion 162 to a sufficient distance that allows a person to securely grasp it once second member 170 has been overlaid. However, non-perpendicular angles are also contemplated. For example, protrusion portion 166 could form a triangle having angled sides extending from the disk portion 162, or have other commercially suitable shape(s). In one embodiment the container 110 and plug 120 comprise at least 90 wt % biodegradable materials.

Figure 3:
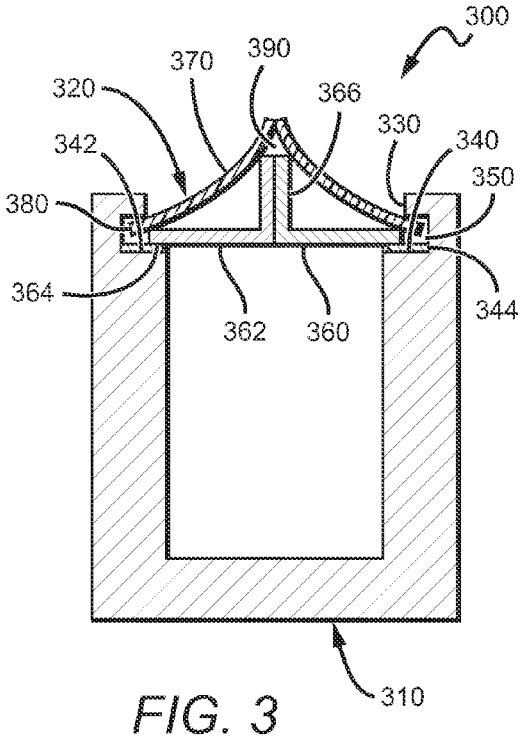
FIGS. 3-4 are cross-sectional views of alternative embodiments of a closure system having a rubber layer.
Figure 4:
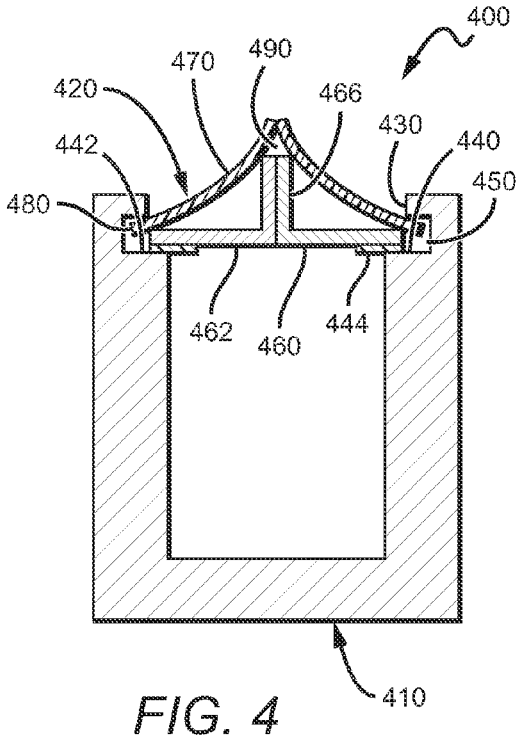

FIG. 1B shows closure system 100 being pinched by fingers 195. When second member 170 is pinched, catch 180 (see FIG. 1A) is retracted from groove 150. The length of first member 160 is sized such that it fits into ridge 130 and rests on land 140. Second member 170 is sized such that it cannot fit into ridge 130 unless it is pinched. Second member 170 is also sized and dimensioned to extend catch 180 into a groove 150 upon releasing the pinch. This effectively locks plug 120 into container 110 and seals closure system 100 at land 140. Further, as shown in FIG. 4, a rubber layer can be added to the bottom of first member 160, or to the top of land 140 as shown in FIG. 3, such that the seal formed between the land 140 and the first member 160 is improved.

Groove 150 and land 140 could be formed into a molded container during the molding process using well known standard methods as shown in FIGS. 1A-1B. Alternatively, groove 150 could be formed by gluing a properly sized cylinder ring within the outer cylinder near ridge 130. Land 140 could be formed by gluing or pressing in a cylinder that is thicker than the retaining cylinder within the outer cylinder an appropriate distance below ridge 130. The cylinder could be a relatively short ring, or could extend to the bottom of container 110 as desired. The appropriate distance between ridge 130 and land 140 is determined by a combined thickness of the first and second members 160 and 170, (and any added rubber layer underneath first member 160). It is contemplated that groove 150 could have a wall with a cylindrical, polygonal or other commercially suitable shape. Preferably, groove 150 has a height of between 2 mm and 1 cm.

Second member 170 could be shaped to present two circular edges that do not necessarily define a circle when pinched over first member 160; that is, each half could define a substantial but not complete hemi-circle. However, the overall shape of second member 170 should be configured to provide enough play to allow second member 170 to occupy the space in groove 150 when first member 160 is placed upon land 140 and second member 170 is extended. In addition, the second member 170 should be thick enough to provide sufficient stiffness to positively engage a secure connection under ridge 130 when plug 120 is installed, yet flexible enough for someone with average hand strength to operate. Preferably, second member 170 is configured to be outwardly biased such that the plug 120 is retained with container 110 until the plug 120 is pinched and removed from the container 110.

First member 160 and second member 170 can be coupled at joint 190, as shown in FIG. 1A using a sufficiently strong and durable adhesive or other commercially suitable fastener(s). For example, joint 190 could alternatively be formed from sewing the two members 160 and 170 together with a biodegradable thread. Furthermore, it is conceived that second member 170 may be formed with a partially folded crease at the midsection where it is to be joined with first member 160 such that second member 170 is positioned to operate with minimum of effort and pinching. Once plug 120 is engaged in container 110, it should provide sufficient closure such that container 110 may be lifted by the edges without retracting catch 180.

Figure 2:
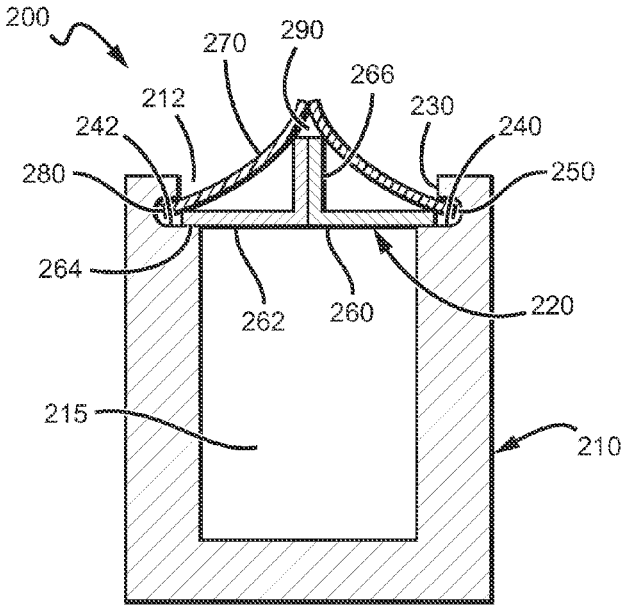
FIG. 2 is a cross-sectional view of another embodiment of a closure system.

In FIG. 2, a closure system 200 is shown having a container 210 and a plug 220. Container 210 can have a ridge 230, a land 240, and a groove 250 between the ridge 230 and land 240. The groove 250 can have a circular cross-section, although other commercially suitable shapes are contemplated. With respect to the remaining numerals in FIG. 2, the same considerations for like components with like numerals of FIG. 1A apply.

FIG. 3 shows a closure system 300 having a container 310 comprising a ridge 330, a land 340, and a groove 350 between the ridge 330 and land 340. Container 310 can also have a plug 320. A rubber layer 344 can be coupled to an upper surface 342 of land 340 such that a seal is effected when the plug 320 is inserted into container 310. With respect to the remaining numerals in FIG. 3, the same considerations for like components with like numerals of FIG. 1A apply.

In FIG. 4, a closure system 400 is shown having a container 410 comprising a ridge 430, a land 440, and a groove 450 between the ridge 430 and land 440. Container 410 can also have a plug 420. A rubber layer 444 can be coupled to a bottom surface 462 of first member 460 such that a seal is effected when the plug 420 is inserted into container 410. It is contemplated that rubber layer 444 can cover the entire bottom surface 462 or a portion thereof. With respect to the remaining numerals in FIG. 4, the same considerations for like components with like numerals of FIG. 1A apply.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C and N, the text should be interpreted as requiring only one element from the group, not A plus N, or B plus N, etc.

What is claimed is:

1. A closure system comprising:

a container having a ridge, a land, and a groove disposed between the ridge and the land, wherein the ridge and land at least partially define upper and lower portions of the groove, respectively;

a resealable plug having a first member comprising a protrusion portion that extends perpendicularly from a disk portion wherein the disk portion is sized and dimensioned to rest within the groove, and a pinchable second member coupled to the first member, such that the second member overlies the protrusion portion, wherein the second member comprises a catch that is extendable into, and retractable from, the groove at an angle with respect to the disk portion;

wherein the resealable plug is configured to removably engage the container, such that (i) the catch bypasses the ridge when the second member is pinched, and (ii) the catch, after bypassing the ridge, extends into the groove when the second member is released; and wherein each of the container and the resealable plug comprises at least 90 wt % biodegradable materials.

2. The system of claim 1, wherein the ridge is positioned within 1 cm of an opening of the container.

3. The system of claim 1, wherein the catch is outwardly biased.

4. The system of claim 1, wherein the container comprises a fibrous material.

5. The system of claim 1, wherein at least one of an inner and outer surface of the container has a permeation barrier.

6. The system of claim 1, wherein the container defines a mouth having a diameter between 5 mm and 80 mm.

7. The system of claim 1, wherein the first member comprises a fibrous material, and wherein the second member comprises a latex.

8. The system of claim 1, wherein at least one of the first and second members comprises a latex.

9. The system of claim 1, wherein the first and second members are coupled together using at least one of an adhesive and a thread.

10. The system of claim 1, further comprising a rubber layer coupled to a bottom surface of the first member, wherein the rubber layer is configured to provide a seal at the land.

11. The system of claim 1, wherein the ridge, land, and groove are disposed on an interior wall of the container.

12. A closure system comprising:

a container having a ridge and a land, wherein the ridge and land collectively define upper and lower surfaces of a groove disposed between the ridge and the land;

a resealable plug having a first member comprising a protrusion that extends perpendicularly from a disk portion, wherein the disk portion is sized and dimensioned to rest within the groove, and a pinchable second member coupled to the first member at a joint having a catch that is extendable into, and retractable from, the groove at an angle with respect to the disk portion;

wherein the second member overlies the protrusion portion;

wherein the resealable plug is configured to removably engage the container, such that (i) the catch bypasses the ridge when the second member is pinched, and (ii) the catch, after bypassing the ridge, extends into the groove when the second member is released; and wherein each of the container and the resealable plug comprises at least 90 wt % biodegradable materials.

13. The closure system of claim 12, wherein the catch comprises an end portion of the second member.

14. A closure system comprising:

a container having a ridge and a land, wherein the ridge and land collectively define upper and lower portions of a groove disposed between the ridge and the land;

a resealable plug having a first member comprising a protrusion portion that extends perpendicularly from a disk portion, wherein the disk portion is sized and dimensioned to rest within the groove, and a pinchable second member coupled to the first member that is extendable into, and retractable from, the groove at an angle with respect to the disk portion;

wherein the second member overlies the protrusion portion;

wherein the resealable plug is configured to removably engage the container, such that (i) the catch bypasses the ridge only when the second member is pinched, and (ii) the catch, after bypassing the ridge, extends into the groove when the second member is released; and wherein each of the container, the first member, and the second member comprises at least 90 wt % biodegradable materials.

15. The closure system of claim 14, wherein the second member is flexible such that the second member can extend into, and retract from, the groove when the second member is released and pinched, respectively.

16. The system of claim 1, wherein the groove has a circular horizontal cross-section.

* * * * *